US009757617B2

(12) United States Patent
Bell

(10) Patent No.: US 9,757,617 B2
(45) Date of Patent: Sep. 12, 2017

(54) METHODS AND APPARATUSES FOR OROPHARYNGEAL ISOMETRICS AND DYNAMICS

(71) Applicant: Tiffany Bell, Jacksonville, FL (US)

(72) Inventor: Tiffany Bell, Jacksonville, FL (US)

( * ) Notice: Subject to any disclaimer, the term of this patent is extended or adjusted under 35 U.S.C. 154(b) by 106 days.

(21) Appl. No.: 14/952,980

(22) Filed: Nov. 26, 2015

(65) Prior Publication Data

US 2016/0144227 A1 May 26, 2016

Related U.S. Application Data

(60) Provisional application No. 62/085,101, filed on Nov. 26, 2014.

(51) Int. Cl.

| | |
|---|---|
| ***A63B 23/03*** | (2006.01) |
| ***A63B 21/00*** | (2006.01) |
| ***A63B 21/02*** | (2006.01) |
| ***A63B 21/04*** | (2006.01) |
| *A63B 21/002* | (2006.01) |
| *A63B 71/00* | (2006.01) |

(52) U.S. Cl.

CPC ..... *A63B 23/032* (2013.01); *A63B 21/00061* (2013.01); *A63B 21/023* (2013.01); *A63B 21/0428* (2013.01); *A63B 21/0023* (2013.01); *A63B 21/4047* (2015.10); *A63B 71/0036* (2013.01)

(58) Field of Classification Search

CPC ..... A63B 23/032; A63B 21/00061; A63B 21/023; A63B 21/0428; A63B 21/4047; A63B 21/0023; A63B 71/0036; A63B 23/025; A63B 21/4003; A63B 23/03; A63B 21/4025; A63B 21/00069; A63B 21/065

USPC ..... 482/11, 10

See application file for complete search history.

(56) References Cited

U.S. PATENT DOCUMENTS

| | | | | |
|---|---|---|---|---|
| 3,497,217 | A | 2/1970 | Feather | |
| 3,784,195 | A | 1/1974 | Johnson | |
| 5,213,553 | A | 5/1993 | Light | |
| 6,050,961 | A | 4/2000 | Arnold | |
| 6,190,335 | B1 | 2/2001 | Howard | |
| 6,406,404 | B1 * | 6/2002 | Chu | A63B 23/032 482/11 |
| 6,524,262 | B1 | 2/2003 | Akihiro | |
| 7,083,548 | B1 * | 8/2006 | Moore | A63B 23/032 482/11 |
| 7,238,145 | B2 | 7/2007 | Robbins | |

(Continued)

*Primary Examiner* — Andrews S Lo

(74) *Attorney, Agent, or Firm* — Mederos Legal, PLLC; Diana Mederos

(57) ABSTRACT

Apparatuses and methods for an oropharyngeal exercise device. The oropharyngeal exercise device has interchangeable parts comprising complete mouthpieces, complete springs, a housing, a progress gauge, and a stopper. The oropharyngeal exercise device and its interchangeable parts are organized and stored in a standardized kit. The kit allows a patient to take the exercise device on the go and makes home-health treatment of oropharyngeal disorders easier and more accessible. Patients can customize the exercise type and resistance. A variety of mouthpieces also allows patients to perform not only isometric exercises, but also perform dynamic exercises to increase flexibility and range of motion.

20 Claims, 8 Drawing Sheets

(56) References Cited

U.S. PATENT DOCUMENTS

| | | | | |
|---|---|---|---|---|
| 7,476,180 | B1 * | 1/2009 | Cobb | A63B 21/0004 482/11 |
| 8,376,912 | B1 | 2/2013 | Dedvukaj | |
| 2003/0078139 | A1 | 4/2003 | Norton | |
| 2006/0122036 | A1 * | 6/2006 | Ferrara | A63B 21/02 482/11 |
| 2008/0183107 | A1 | 7/2008 | Miller | |
| 2010/0041525 | A1 * | 2/2010 | Lucano | A63B 21/0004 482/121 |
| 2010/0222706 | A1 | 9/2010 | Miyahara | |
| 2011/0190666 | A1 | 8/2011 | Friedland | |
| 2012/0143091 | A1 | 6/2012 | Annett | |
| 2012/0208677 | A1 * | 8/2012 | Lally | A63B 23/032 482/11 |
| 2012/0283069 | A1 * | 11/2012 | Martin | A63B 23/032 482/11 |
| 2013/0260963 | A1 | 10/2013 | Takashi | |
| 2014/0066258 | A1 * | 3/2014 | Smead | A63B 21/02 482/11 |
| 2014/0142415 | A1 | 5/2014 | Cunningham et al. | |
| 2015/0038299 | A1 * | 2/2015 | Kezirian | A63B 23/025 482/10 |
| 2015/0251051 | A1 * | 9/2015 | Mohammed | A63B 23/032 482/11 |

* cited by examiner

METHODS AND APPARATUSES FOR OROPHARYNGEAL ISOMETRICS AND DYNAMICS

CROSS REFERENCE TO RELATED APPLICATIONS

This application claims the benefit of provisional application No. 62/085,101 having a filing date of Nov. 26, 2014, and entitled, "Methods and Apparatuses for Oropharyngeal Isometrics and Dynamics."

FIELD OF THE DISCLOSURE

The present disclosure relates to methods and apparatuses for an oropharyngeal exercise device. More specifically, the present disclosure presents an oropharyngeal exercise device comprising interchangeable parts organized and stored in a kit. The interchangeable parts correspond to various resistances and various isometric and dynamic exercises for the tongue, lips, and jaw.

BACKGROUND OF THE DISCLOSURE

Traditionally, speech therapists and speech pathologists work with patients who have oropharyngeal anomalies, injuries, or deficiencies. Oral phase dysphagia patients and those with oral weaknesses may suffer from speech deficits and dysarthria. Various speech and swallowing deficits and disorders may be congenital or acquired. Some examples of conditions that cause oropharyngeal disorders are stroke, traumatic brain injury, dementia, multiple sclerosis, and aging.

Increasing muscle mass and improving coordination helps these patients. Traditionally, the Iowa Oral Performance Instrument would be used that would involve exercises with tongue depressors. A patient would be able to perform limited isometric tongue movements of tongue base, middle, and tip elevation; tongue lateralization within the oral cavity; and lip compression. Some patients require a combination of various exercises and movements of the oropharynx. Traditional methods and apparatuses limit a patient's progress. Most of the time, a patient is confined to performing repetitious movements of which the oropharynx becomes accustom. Therefore, over time, the isometric movements with the same are not challenging and do not allow patients to continue improving oropharyngeal strength and range of movement.

Measuring progress has traditionally been done by using bulky and stationary measurement devices that are expensive and generally only used in a speech pathologist's office. In some situations, a new device would need to be used for each different exercise and would be difficult to accommodate patients with impaired mobility and those who need a long-term care plan.

Complicated machinery in a speech pathologist's office also generally requires training and skills for using a complex oropharyngeal exercise device. Although this would not be a problem when the patient visits the speech pathologist, the patient has little to no options for continuing treatment in between office visits. Building oropharyngeal strength and coordination is a continuous process where oropharyngeal exercises traditionally increase in repetitions, time, and resistance. Various exercises are typically needed to yield a synergistic and more holistic prognosis.

In addition, health insurance companies may be reluctant to completely cover the cost of purchasing a high-tech and expensive isometric exercise device. This especially becomes a problem for most oral phase dysphasia patients who are on a fixed income or who are disabled. Furthermore, patients may outgrow one device and may need to purchase a completely new oropharyngeal exercise device

SUMMARY

What is needed is a cost-effective, customizable, and portable oropharyngeal exercise device that also allows patients to perform isometric as well as dynamic exercises. The oropharyngeal dynamic and isometric exercise devices described herein allow patients affordable and simple methods and apparatuses for building oropharyngeal strength and coordination.

The device described herein is an oropharyngeal exercise device having at least a housing, where a complete spring is placed inside the housing, and a complete mouthpiece that attaches to the complete spring through a housing shaft opening. The complete mouthpiece and complete spring have a corresponding male and female fastener. The complete mouthpiece comprises a mouthpiece where the tongue, lips, or chin is applied; and a mouthpiece stem with a fastener on the distal end close to the housing and farther away from the mouthpiece. The complete spring comprises a spring with at least one base having a fastener and attached to the proximal end of the spring. The complete spring and the complete housing are interchangeable. The mouthpiece may be a tongue target, one or more lip pieces, tongue clamp, or lever.

The housing may have a progress gauge with tick marks to show how far down a patient is able to compress the spring with his/her tongue, lips, or chin. After compressing the spring, the patient may press or apply pressure to a stopper on a side opposite the progress gauge to make the stopper protrude toward the spring inside the housing. This prevents the spring and the mouthpiece from returning to its original position too quickly and helps to prevent injuries.

The device with its interchangeable parts is contained in a kit. The kit has molded holders contoured to fit complete springs, complete mouthpieces, and housings. The kit also has storage space. The kit may contain a tongue target, one or more lip pieces, a tongue clamp, and a lever. The kit may contain springs of resistances or pressures between 1 and 20 pounds per square inch.

A patient, health care professional, or other caregiver opens the kit, selects a housing, opens the housing, selects a complete spring, inserts the complete spring into the housing, closes the housing, selects a complete mouthpiece, fastens the mouthpiece to the complete spring, and begins a prescribed isometric and for dynamic oropharyngeal exercise.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

Figure 1A:
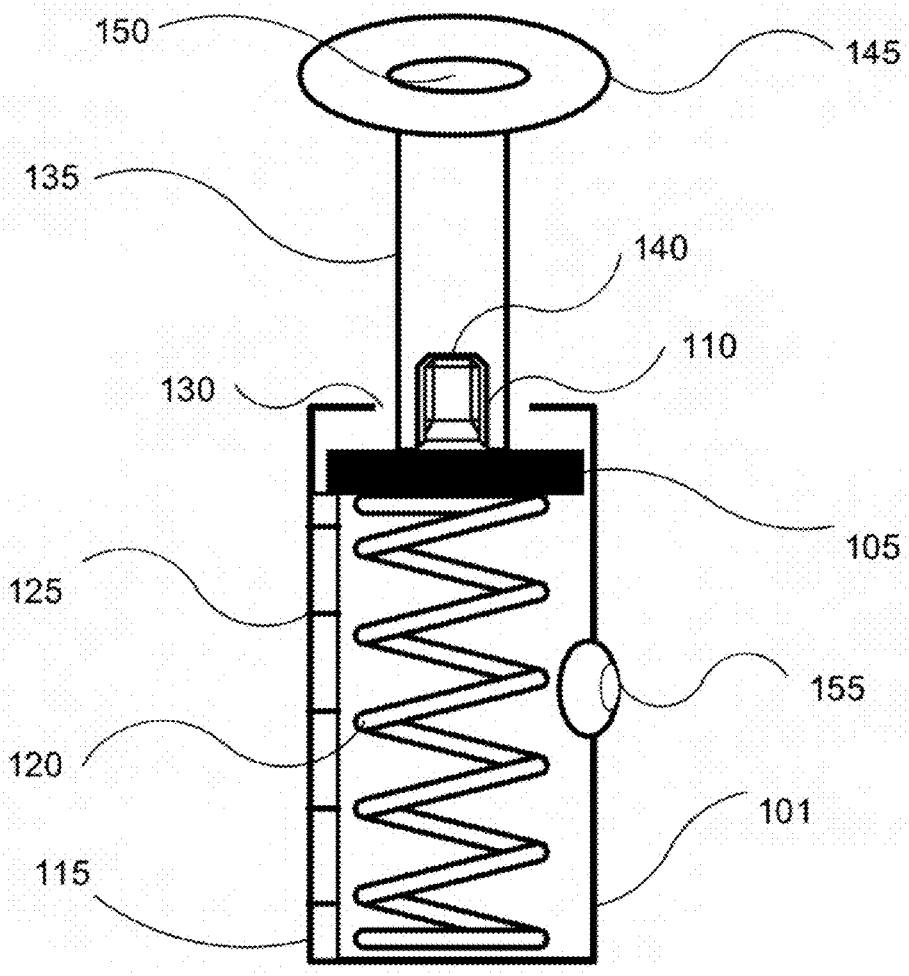
FIG. 1A illustrates a front view of an exemplary embodiment of an oropharyngeal exercise device.

The present disclosure provides generally for methods and apparatuses for oropharyngeal dynamics and isometrics. According to the present disclosure, an oropharyngeal exercise device comprises basic interchangeable parts that may be included in a kit for easy and portable use. There are three exemplary basic interchangeable parts that make up an oropharyngeal exercise device: a housing, a complete spring, and a complete mouthpiece. A kit may include several compartments designed to custom it a series of complete springs and complete mouthpieces.

Having interchangeable parts in a kit allows for a variety of resistance treatments and exercise types that may be isometric or dynamic. The exercise device is cost effective and customizable because the apparatus is comprised of interchangeable parts included in a kit. A patient or health care provider ma change the resistance by selecting from a plurality of springs and may change the exercise performed by selecting from a plurality of mouthpieces. A patient may take the exemplary exercise device and kit on the go, and having a standard kit with customizable options simplifies home-health treatment.

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

Generally, the exemplary apparatus described herein is an oropharyngeal exercise device with its exemplary kit that allows a patient to perform customized dynamic and isometric lip, tongue, and jaw movements.

GLOSSARY

"complete mouthpiece" as used herein means a single apparatus comprising a mouthpiece stem, a female fastener, and a mouthpiece.

"complete spring" as used herein means a single apparatus comprising a spring, a base, and a male fastener.

"mouthpiece" as used herein means any of the following: a device for placement in, on, or near the mouth and that has either a tongue target, a lever, a tongue clamp, or one or more lip pieces.

"mouthpiece stem" as used herein means the arm that connects the mouthpiece to the base.

DETAILED DESCRIPTIONS OF THE DRAWINGS

The exercise device is cost effective and customizable because the apparatus is comprised of interchangeable parts included in a kit. A patient can change the resistance by selecting from a plurality of springs and can change the exercise performed by selecting from a plurality of mouthpieces. A patient can take the exemplary exercise device and kit on the go, and having a standard kit with customizable options simplifies home-health treatment. Exemplary embodiments presented in the drawings will now be described.

Referring now to FIG. 1A, an exemplary embodiment of an oropharyngeal exercise device is shown. A device may contain a housing 101. A housing 101 may have a cylindrical, rectangular prism, or cuboidal shape. The sides of the three-dimensional shape define sides of the housing 101. The sides of the housing are connected at edges. 101 A housing 101 may be made out of a synthetic polymer or a natural material. For example, a housing 101 may be made out of plastic or may be made out of wood. In some embodiments, a housing 101 may be made out of a recyclable material such as a metal like aluminum. In some embodiments, a housing 101 may contain handles, grip spots, or an apparatus that may allow an addition of one or more handles (not illustrated). In some embodiments, a housing 101 may be transparent, translucent, or opaque.

In some embodiments, a housing 101 may have a shaft opening 130. A shaft opening 130 may be a center opening on at least one end of a housing 101. A shaft opening 130 may be at the proximal end of the housing 101 closest to the mouthpiece 145. A housing 101 may also have a second shaft opening 130 at the distal end of the housing 101, furthest away from the mouthpiece 145. In some embodiments, a shaft opening 130 may be present on opposite sides of a device. A shaft opening 130 may be wide enough to allow a mouthpiece stem 135 to compress a spring 120 but not wide enough for a base 105 to exit a housing 101. In some embodiments, a housing may have brackets or fasteners on the outside to where accessories such as a mouth guard, face shield, or straps may be attached for hands-free use.

In some embodiments, a device may have a stopper 155. A stopper 155 may be fixed within a side of a housing 101. A stopper 155 may have a circular or oval shape that protrudes into both the interior and to the exterior of a housing 101. A stopper 155 may have a concave depression or a convex bubble on the center of the surface. A stopper 155 may be made out of natural and/or synthetic materials. For example, a stopper 155 may be made out of natural rubber or a soft plastic. In some embodiments, a stopper 155 may be made of a malleable material and shaped in a bubble-like structure that is pressed by a patient to facilitate a protrusion into a housing 101 and may automatically retract when not pressed. In some embodiments, a stopper 155 may be a solid fixed structure with a protrusion that may be extended and retracted manually. In some embodiments, when a stopper 155 is depressed on the outside, a stopper 155 protrudes into an interior of a housing 101 and may touch a spring 120 to prevent a spring from springing hack toward the top of a housing. A stopper 155 may prevent a mouthpiece 145 from injuring a patient after a spring has been compressed and needs to be released.

A device may have a progress gauge 115. A progress gauge 115 may be as transparent or clear window that may be open or contained with a transparent material such as Plexiglas. A progress gauge 115 may allow a patient to visualize spring 120 compression progress. In some embodiments, a patient may compress a spring 120, and a base 105 may move down a housing 101. When a base 105 moves down, a patient may visualize a base 105 through a progress gauge 115. A progress gauge may have progress marks 125. Progress marks 125 may be simple solid tick marks along a progress gauge 115. For example, at every centimeter, a horizontal solid progress mark 125 may be present on a progress gauge 115. Progress marks 125 may be numbered, may correspond to a spring compression pressure, or may be a solid line.

A device may have a spring 120. A spring 120 may have a resistance or pressure from 1 to 20 pounds per square inch. A spring 120 may have a coil thickness that may correspond to the desired resistance Of pressure. A spring 120 may have a length of 2 centimeters to 20 centimeters. A spring 120 may have ends that may be closed or may be open. A spring 120 may have 2 to 20 coils. A spring 120 may be made out of metal or a synthetic polymer. For example, a spring 120 may be made out of copper, aluminum, stainless steel, or a plastic.

A device may have a base 105. A base 105 may be made out of a natural or a synthetic material. For example, a base 105 may be made out of wood, aluminum, or plastic. A base 105 may be fixably or removably attached to a spring 120. In some embodiments, a base 105 may be permanently glued to the top of a spring 120. In some embodiments, a base 105 may have a female fastener 140 or a male fastener 110 fixedly or removably attached that may allow for connecting additional apparatuses. Either a male fastener 110 or a female fastener 140 may be permanently fixed to a base 105.

A device may have a male fastener 110. A male fastener 110 may be fixed to as base 105 or fixed to a mouthpiece stem 135. In some embodiments, a male fastener 110 may have a traditional screw body or have a three-dimensional geometric shape that may also be an irregular shape.

A device may have a mouthpiece scan 135, A mouthpiece stem 135 may have a length of 5 centimeters to 20 centimeters. A mouthpiece stem 135 may have a fixed length or a variable length. For example, a mouthpiece stem 135 may have a telescopic capability. In some embodiments, a mouthpiece stem 135 may include either a female fastener 140 or a male fastener 110. A mouthpiece stem 135 may contain it mouthpiece 145 at one end and a fastener 140 or 110 at another end.

A device may have a female fastener 140 or a male fastener 110. In some embodiments, a female fastener 140 and a male fastener 110 may have magnetic properties. In some embodiments, a female fastener 140 or a male fastener 110 may fasten to each other with a snap-in feature or a screw-in feature, lock, or clasp. A fastener 140 or 110 may be made of a natural, or synthetic material.

A device may have a mouthpiece 145. A mouthpiece 145 may be made of a natural or a synthetic material. A mouthpiece 145 may be shaped in a polygon, oval, saddle, concave, or convex shape. A mouthpiece 145 may have a firm or semi-soft texture or firmness. A mouthpiece 145 may have a tongue target 150. A tongue target 150 may have one or more contour lines on a mouthpiece 145. A tongue target 150 may aid a patient to properly position the tongue, chin, or lips. In some embodiments, a mouthpiece 145 may have a disposable slip cover that may aid in hygienic use of a device.

Figure 1B:
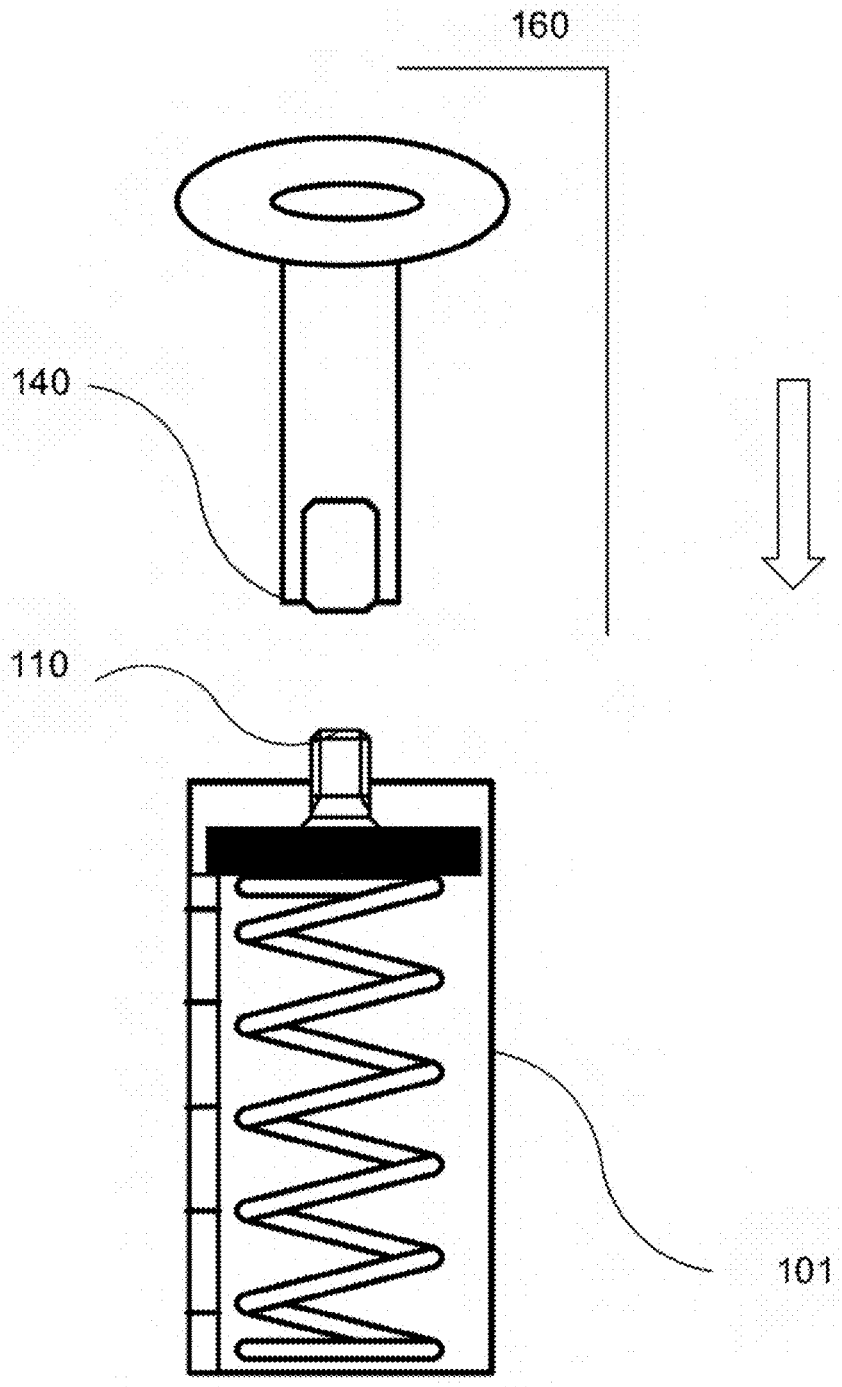
FIG. 1B illustrates a front view of an exemplary complete mouthpiece and how an exemplary complete mouthpiece may connect to an exemplary fastener.

Referring now to FIG. 1B, an exemplary complete mouthpiece and how it ma connect to an exemplary fastener is illustrated. In some embodiments, a patient may take a complete mouthpiece 160 that may have a female fastener 140 and fasten or secure a complete mouthpiece 160 to a housing 101 with a male fastener 110. For example, a male fastener 110 may lit inside a female fastener 140. In some embodiments, a complete mouthpiece 160 may be secured magnetically or by a screw-in or snap-n feature. A complete mouthpiece 160 is preferably attached to the male fastener 110 along a longitudinal axis and substantially in line with a complete spring in the housing 101. The longitudinal axis and substantial in-line alignment is demonstrated by the arrow pointing to the direction which the complete mouthpiece 160 is attached to the remainder of the device.

Figure 1C:
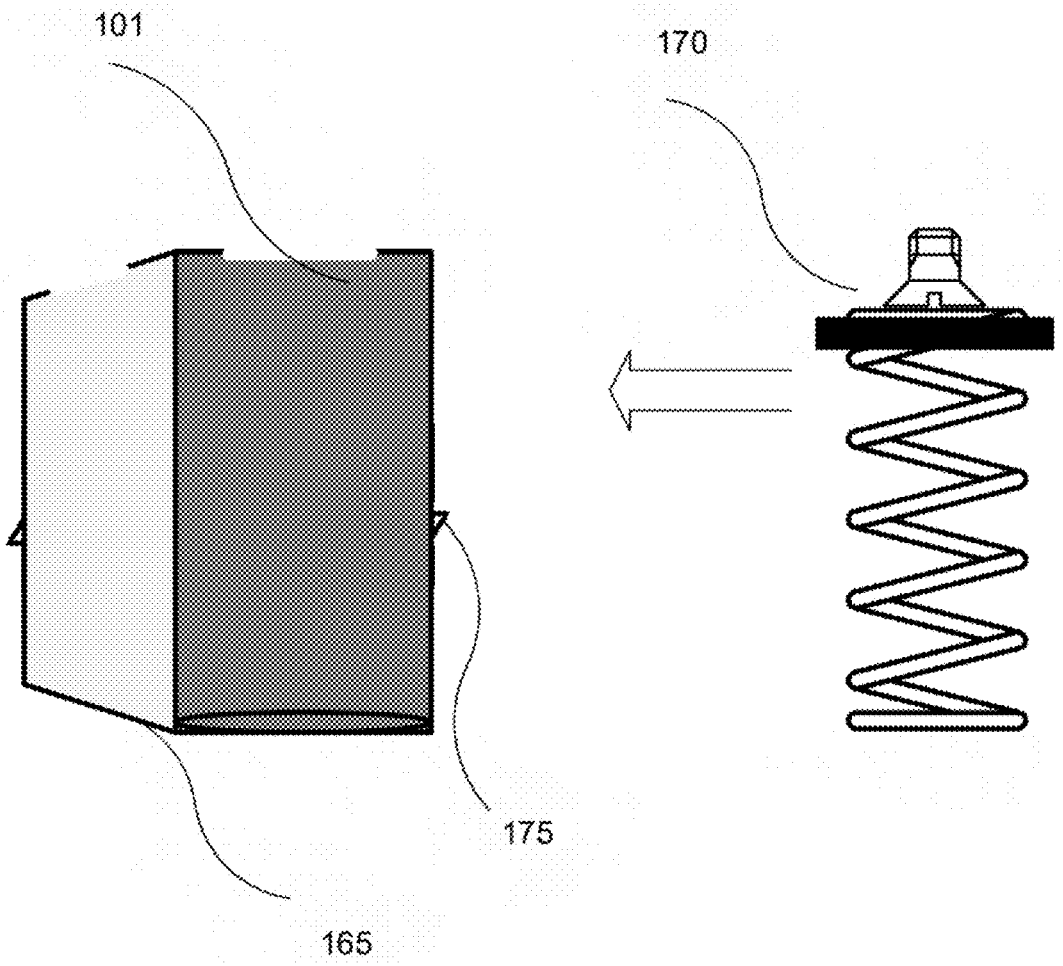
FIG. 1C illustrates a front view of an exemplary embodiment of a complete spring being loaded into a housing.

Referring now to FIG. 1C, an exemplary embodiment of a complete spring being loaded into a housing is illustrated. In some embodiments, a housing 101 may have a door 165. A door 165 may be connected to a housing 101 by one or more hinges (not illustrated) on an edge of the housing 101 where the door 165 meets the housing 101. A housing 101 may contain one or more clasps 175 on an opposite edge of the housing 101 than that of the hinge or hinges. A hinge may be an apparatus to allow the door 165 to swing back and forth so as to open and close the housing 101. In some embodiments, a housing 101 may have a clasp 175 on one side as well as a clasp on a door 165 that opens and closes. A clasp 175 may have any of the following shapes: round, flat, elevated, triangular, trapezoidal, or spherical. A clasp 175 may be made out of a natural or a synthetic material. For example, a clasp 175, a door 165, and a housing 101 may all be made out of the same material, such as plastic, or may each be made of a different material. In some embodiments, a clasp 175 may have magnetic properties or may snap like a puzzle piece with another clasp 175. A clasp 175 may be released, to open the door 165 or may be secured to close the door 165.

in some embodiments, a complete spring 170 may fit inside a housing 101. A clasp 175 may be squeezed or pressed to release a door 165, so a complete spring 170 may be inserted into a housing 101. A complete spring 170 may be compressed to fit easier into to housing 101. A complete spring 170 may be secured in a housing 101 when a door 165 is closed and a clasp 175 touches or locks with another clasp 175.

Figure 2A:
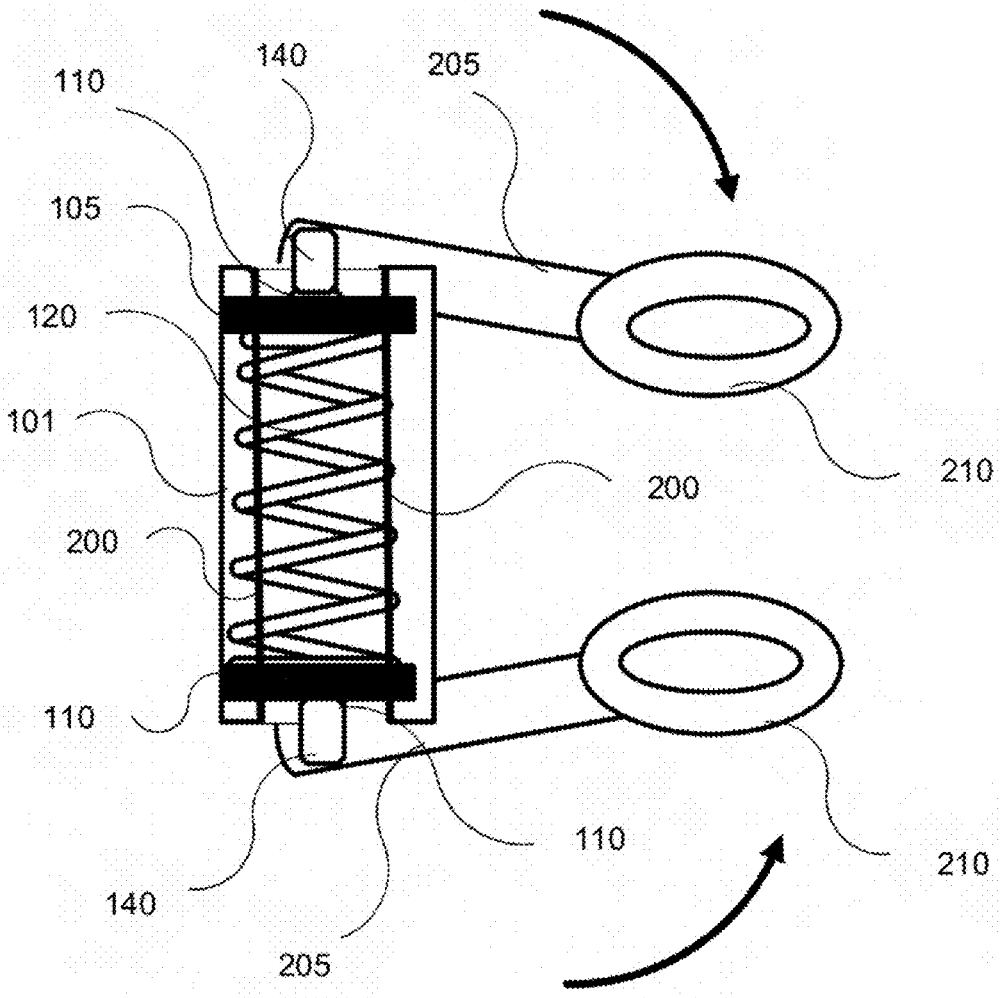
FIG. 2A illustrates a front view of an exemplary embodiment of an oropharyngeal exercise device with two lip pieces removably attached.

Referring now to FIG. 2A, an exemplary embodiment of an oropharyngeal exercise device with two lip pieces is illustrated. In some embodiments, a housing 101 may contain one or more housing walls having a window opening 200. A window opening 200 may expose a spring 120. A window opening 200 may be present on one side of a housing 101 or on two sides of a housing 101. A window opening 200 may be a center window spanning the length of a housing 101 or may span the width of a housing 101.

One or more lip piece arms 205 may travel along a housing 101, without obstruction, any may facilitate compression of a spring 120. A lip piece arm 205 may contain a female fastener 140 that may fasten to a male fastener 110 that may be present on a base 105. In some embodiments, a spring 120 may have a base 105 at each end where a lip piece arm 205 may be attached. Compression may be applied at each lip piece 210 and lip piece arm 205 to where a spring 120 may compress from either end.

A lip piece arm 205 may contain a lip piece 210 that may he permanently fixed to a lip piece arm 205 or may be removable. A lip piece arm 205 may be extendable or at a fixed length. A lip piece arm 205 may be adjusted to where the angle allows for a custom fit for a patient's mouth. A lip piece 210 may be fitted with a disposable cover. A lip piece 210 may be made from a natural material such as rubber latex or may he made from a synthetic material such as a plastic or a silicone. A lip piece 210 may be shaped in an oval, rectangle, square, trapezoid, crescent, or saddle.

Figure 2B:
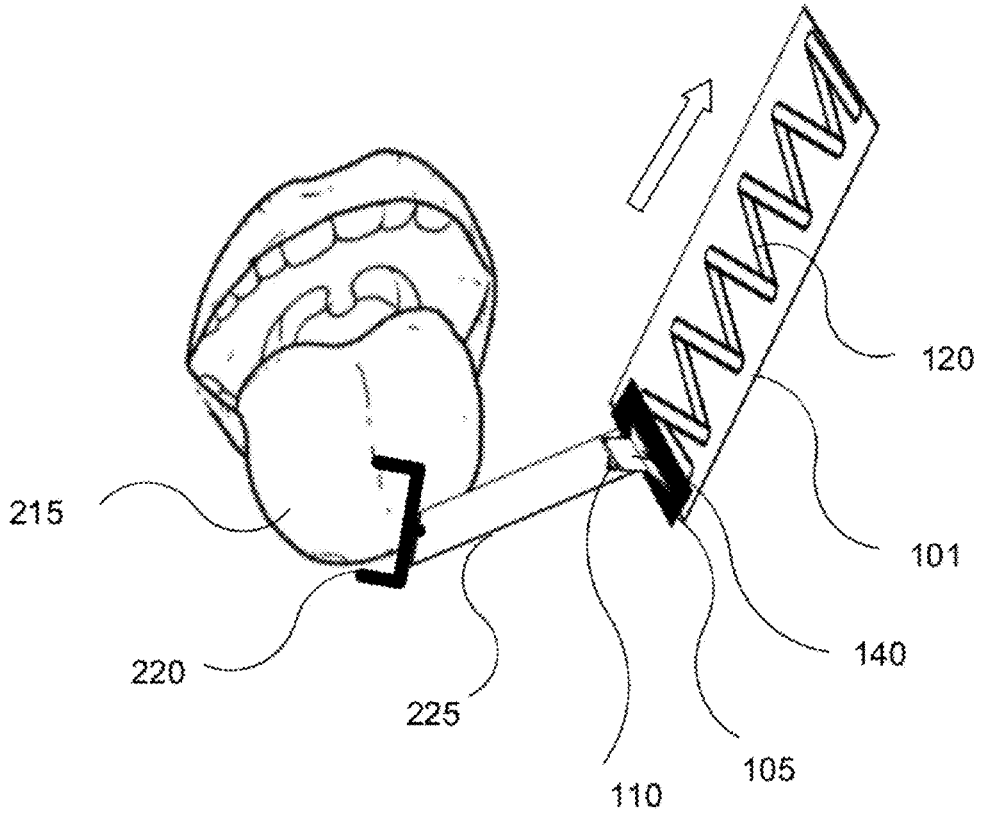
FIG. 2B illustrates a three-quarters view of an exemplary embodiment of an oropharyngeal exercise device with a tongue clamp removably attached.

Referring now to FIG. 2B, an exemplary embodiment of an oropharyngeal exercise device with a tongue clamp is illustrated. In some embodiments, a device may include a housing 101 with a spring 120, female fastener 140, male fastener 110, a base 105, a tongue clamp arm 225, and a tongue clamp 220. A base 105 may have a male fastener 110 that protrudes from a side rather than the top of a base 105. A tongue clamp arm 225 may have a female fastener 140 that may fasten to a male fastener 110 with a screw-in feature. A screw-in type male and female fastener, 110 and 140, may allow a patient greater stability and durability for performing tongue clamp-related exercises.

A tongue clamp 220 may be present at the end of a tongue clamp arm 225. A tongue damp 220 may be in a permanent and fixed position and angle or may be adjustable. For example, a tongue clamp 220 may be attached with a ball-and-socket joint that may allow a patient to position the device comfortably and to allow accurate compression angles and points. A tongue damp 220 may be in the shape of a half square or a half rectangle or a crescent. In some embodiments, a tongue clamp 220 may be adjustable to where the height of the opening may effectively hold on to a tongue 215. A patient's tongue 215 may be placed in between a tongue clamp 220. A tongue clamp 220 may fit firmly with moderate or light pressure. In some embodiments, a tongue clamp 220 may be made from a synthetic substance or a natural substance, or a combination. A tongue clamp 220 may have a metal structure with a silicone coating that may provide cushion and comfort for a patient. A tongue clamp 220 may have a structure that is in a rod shape or flat. A tongue clamp 220 may have soft, rounded edges for patient comfort. A tongue clamp 220 may be made from a malleable and bendable metal or a firm, structured metal.

Figure 2C:
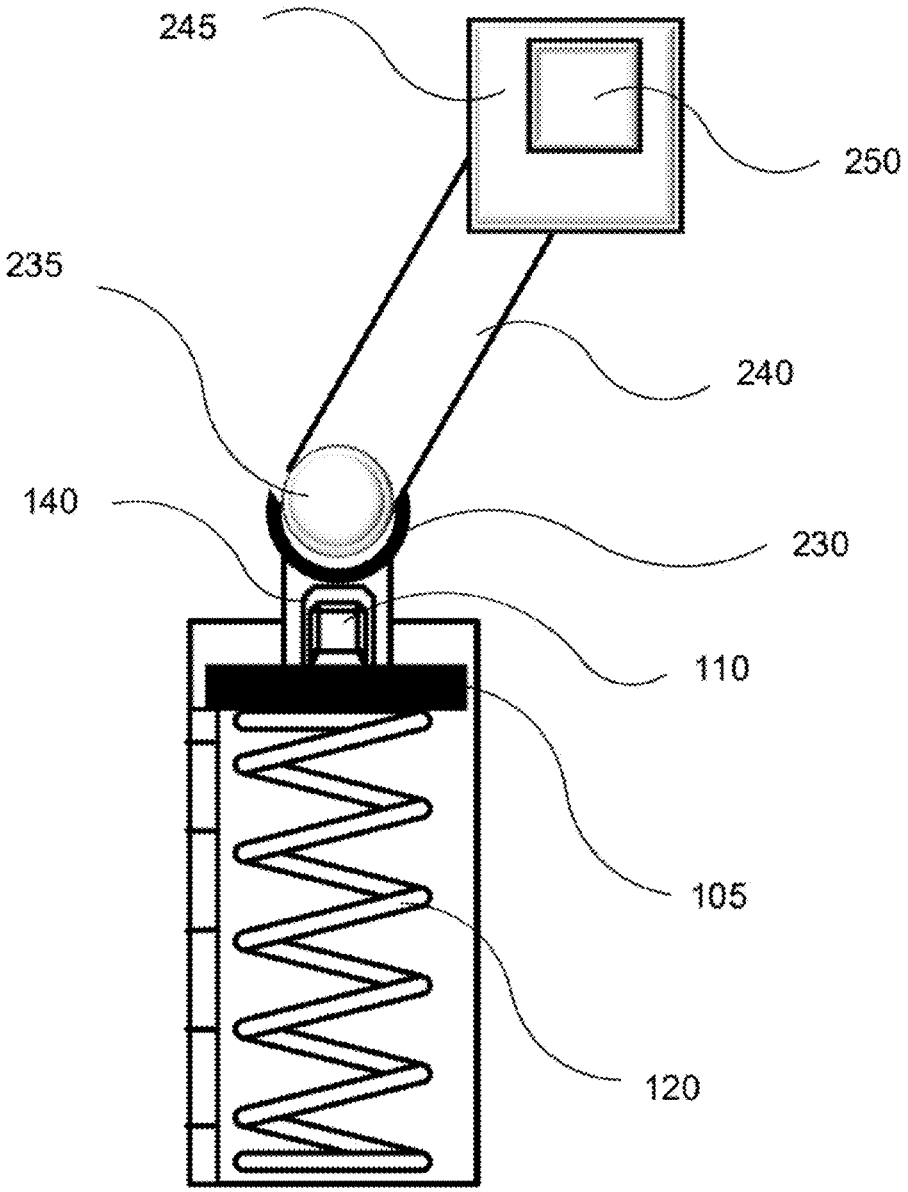
FIG. 2C illustrates a front view of an exemplary embodiment of an oropharyngeal exercise device with a lever removably attached.

Referring nosy to FIG. 2C, an exemplary embodiment of an oropharyngeal exercise device with a lever piece is illustrated. In some embodiments, a device may have as lever 245. A lever 245 may be permanently fixed to a lever arm 240, or a lever 245 may be removable from a lever arm 240. A lever 245 may have a shape of a polygon or of a circle or oval. A lever 245 may have as tilting feature such as a ball-and-socket joint with high friction where the lever 245 meets the lever arm 240, so a patient may easily adjust a device to have an ergonomic angle that may be comfortable for use. A lever 245 may have a lever pad 250 in some embodiments. A lever pad 250 may or may not be cushioned. A lever pad 250 may or may not be centered on a lever 245. A lever pad 250 may contain contour lines that may guide a patient for proper positioning. A lever 245 and a lever pad 250 may be covered by a disposable sheath for hygienic use.

A lever arm 240 may have a fixed length or may be adjustable by a telescopic feature. A lever arm may be made of a synthetic material or a natural material, or a combination. A lever arm 240 may have a bail joint insert 235 at the distal of a lever arm 240 closer to the housing 101. A ball joint insert 235 may have a spherical shape that may fit into a socket joint 230. A socket joint 230 may have a top portion in the shape of a half sphere where a ball joint insert 235 may fit in. A socket joint 230 may have a slightly smaller diameter than a ball joint insert 235 and may be constructed from a material that may stretch to accommodate the insertion of a ball joint insert 235 into a socket joint 230. For example, a socket joint 230 may have a plurality of vertical slits that may allow a socket joint 230 to expand and then return back to the original size for a snug fit with a ball joint insert 235. In some embodiments, a snug fit will create some friction to where a ball joint insert 235 may be positioned by a patient but will remain in that position in a socket joint 230 for the duration of treatment.

A socket joint may be part of a column that may house a female fastener 140. A female fastener may accommodate a male fastener 110 that may be attached to a base which may be attached to a spring. Therefore, in some embodiments, when pressure may be applied to a lever 245, even if from an angle not 180 degrees from a spring 120, pressure may still cause a spring 120 to compress and provide a patient resistance.

Figure 3:
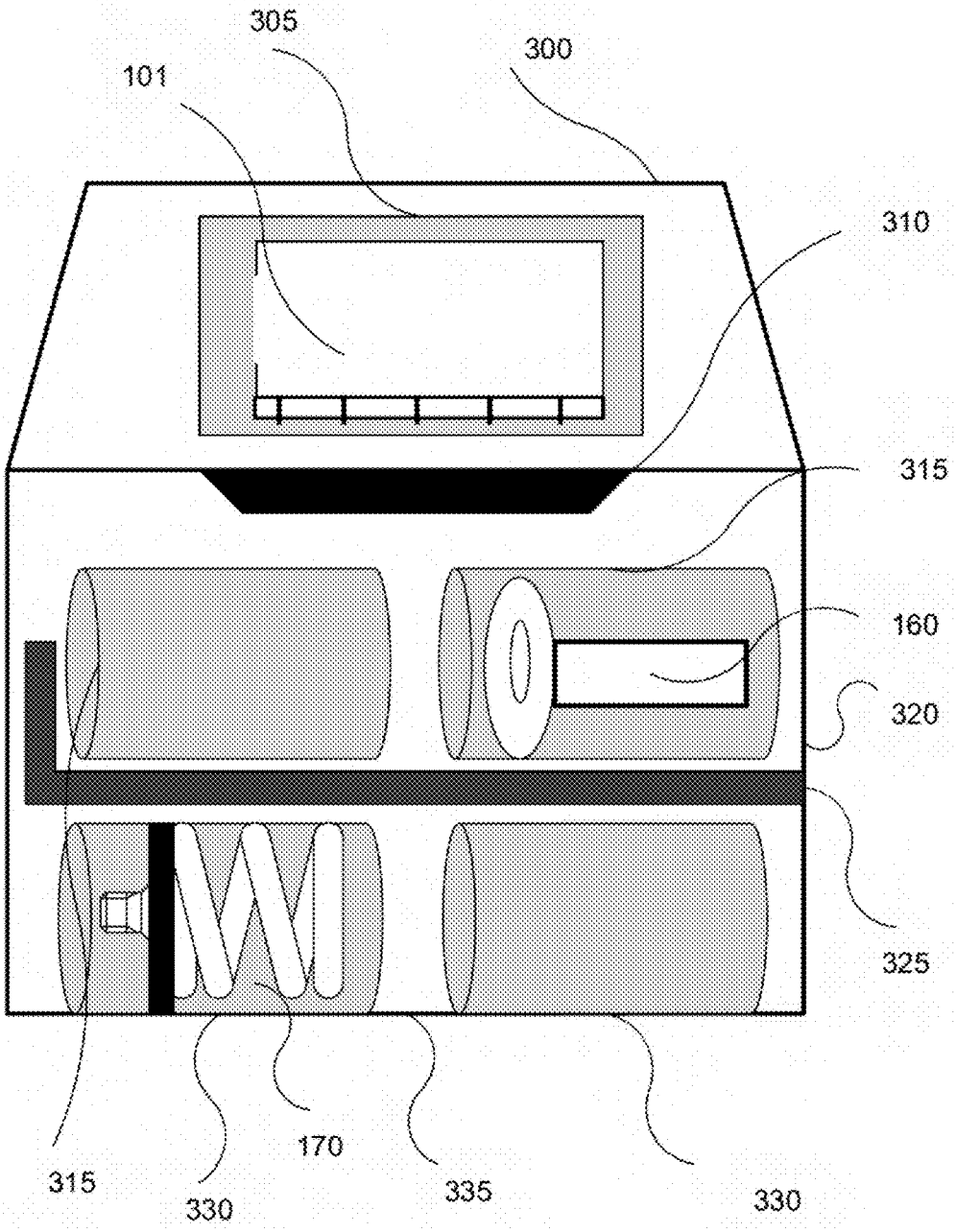
FIG. 3 illustrates a front view of an exemplary embodiment of a kit.

Referring now to FIG. 3, an exemplary embodiment of a kit is illustrated. In some embodiments, a kit comprises a kit container 300. A kit container 300 may be in the shape of a box that may be more of a square or a rectangle or other polygonal shape. In some embodiments, a kit container 300 may be in the shape of a cylinder. In some embodiments, a kit container 300 may be soft bodied with padding on the interior and fabric or leather on the exterior. In some embodiments, a kit container 300 may have a foam or plastic shell that may be bendable, or a kit container 300 may contain a hard, rigid shell such as wood, metal, or PVC plastic. A kit container 300 may have an airtight seal that may prevent contamination. A kit container 300 may have at least one door opening that may be opened and closed with at least one container clasp 310. In some embodiments, a kit container 300 may have a plurality of door openings with a plurality of container clasps 310. A container clasp 310 may have a locking mechanism such as a pad lock or a keypad to input a security code or a fingerprint scan.

A kit container 300 may have a plurality of storage compartments, compartment dividers, and apparatus holders. In some embodiments, a kit container 300 may have a designated housing holder 305 that may be custom molded to securely hold a housing 101. There may be a plurality of housing holders 305 in order to accommodate different sizes or shapes of housings 101.

In some embodiments, a kit container 300 may have a complete mouthpiece holder 315 that that may be custom molded to secure a complete mouthpiece 160. In some embodiments, complete mouthpiece holders may be organized in their own mouthpiece storage compartment 320. A mouthpiece storage compartment 320 may be one or several areas of a kit container 300 that may be separated from other storage compartments but a compartment divider 325. A mouthpiece storage compartment 320 may contain a complete mouthpiece holder 315 that may be custom molded for each type of mouthpieces available such as a lever, lip piece, or tongue damp. A compartment divider 325 may be solid or plush and may be removable or may be fixed into the structure of a kit container 300.

In addition, a kit container 300 may also have a complete spring storage compartment 335. A complete spring storage compartment 335 may house a plurality of complete spring holders 330 that may be custom molded to secure a complete spring 170. A complete spring storage compartment 335 may be separated by a compartment divider 325.

In some embodiments, a kit container 300 may provide additional room for treatment card information storage, storage for accessories, disposable sheaths and alcohol swabs or other disinfectant preparations, pens or pencils, directions, or treatment log books. A kit container 300 may be stored and toted in a patient's purse, briefcase, or luggage, or a kit container may have a built-in handle or a cross-body sling for easy carrying.

Figure 4:
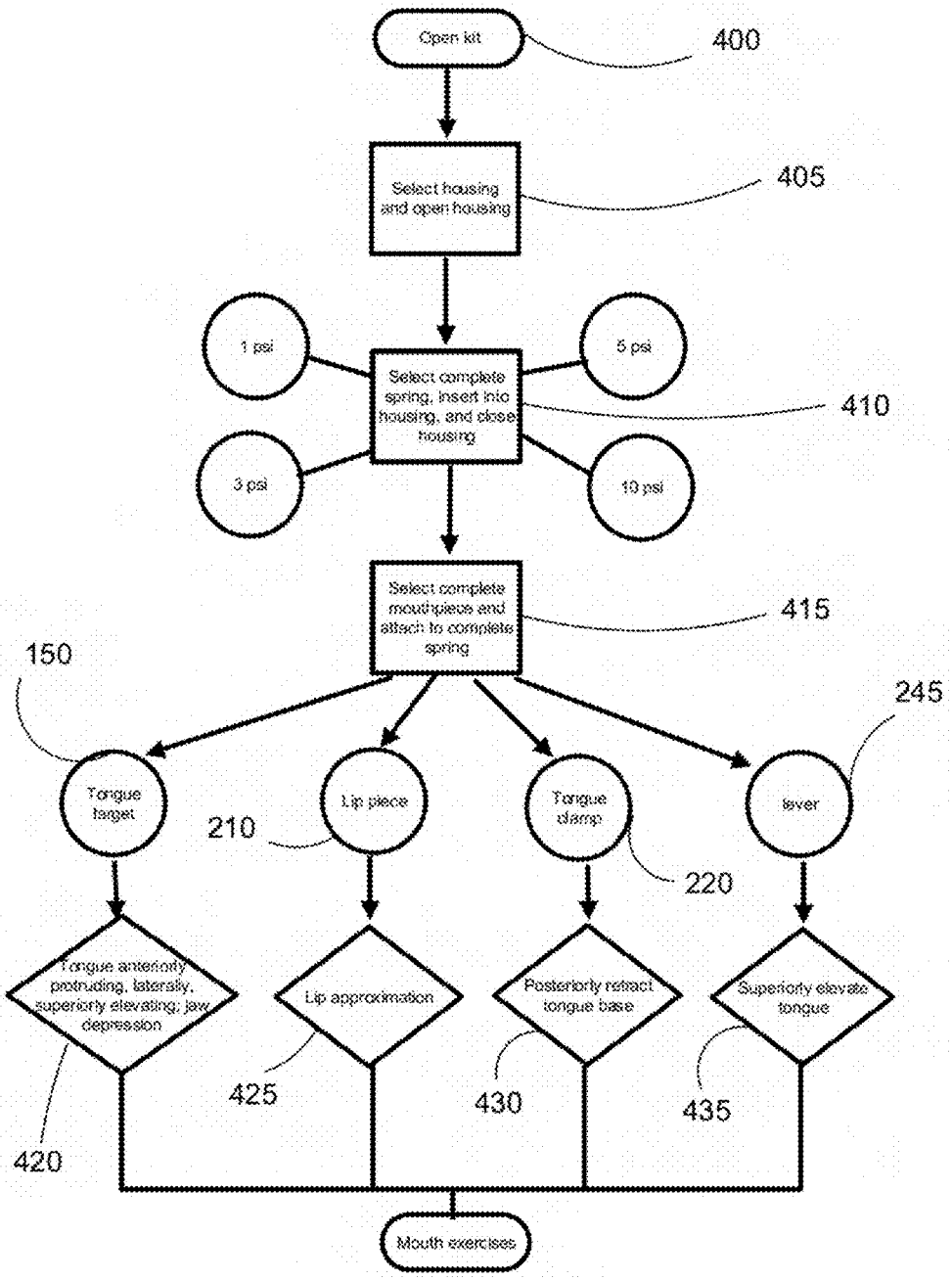
FIG. 4 illustrates exemplary method steps for using an oropharyngeal exercise device to perform mouth exercises.

Referring now to FIG. 4, exemplary method steps for using an oropharyngeal exercise device are illustrated. In some method steps, a patient may open a kit 400. A patient selects a housing and opens a housing 405. A patient selects a complete spring and inserts a complete spring into a housing and closes a housing 410. In some method steps, a patient may select a complete spring having 1 pound per square inch, 3 pounds per square inch, 5 pounds per square inch, or 10 pounds per square inch of resistance or pressure 410. A patient may select a complete mouthpiece and attach a complete mouthpiece to a complete spring 415. In some method steps, a patient may select from the following complete mouthpieces: a tongue target 150, a lip piece 210, a tongue clamp 220, or a lever 245. A patient may perform mouth exercises that may correspond to each complete mouthpiece. A patient may follow a prescribed treatment plan and log his/her exercises in a log book to monitor progress.

In some method steps, a patient may select a tongue target 150. With a tongue target 150 a patient may perform various exercises such as anteriorly protruding the tongue, moving the tongue laterally, superiorly elevating the tongue, and jaw depression 420. In some method steps, a patient may position a device in front of an open mouth to where a tongue target 150 touches the patient's tongue. A patient may protrude the tongue to exert pressure on a tongue target 150 that may compress a spring. A patient may position a tongue target 150 to either side of the tongue while sticking the tongue outside of the mouth. A patient may move the tongue laterally to where the side of the tongue exerts pressure on a tongue target 150 and compresses a spring. A tongue target 150 may also be placed on top of the tongue to where a patient presses against a tongue target 150 to superiorly elevate the tongue. In some method steps, a patient may position his/her chin on top of a tongue target 150 and open and close the mouth for jaw depression exercises to exert pressure on a tongue target 150 and compress a spring.

In sonic method steps, a patient may select a lip piece 210. With a lip piece 210, a patient may perform lip approximation exercises 425. One or two lip pieces 210 may be used—one at the proximal end (top) of the housing 101 and one at the distal end (bottom) of the housing 101 where both ends of the housing 101 have a shaft opening 130. A patient may select how far apart lip pieces 210 may be from each other. A patient may open his/her mouth and position one lip piece 210 just below the upper lip and one lip piece 210 just above the bottom lip. A patient may open and close the mouth by focusing on contracting and squeezing the lips together in order to build lip strength. The same may be performed by placing lip pieces 210 just below the top teeth and just above the bottom teeth and biting down.

In some method steps, a patient may select a tongue clamp 220. With a tongue clamp 220, a patient may perform exercises to posteriorly retract the tongue base 430. A patient may place his/her tongue in between the tongue clamp 220 and may hold a device in front of the face while the mouth is open and tongue sticking out. A patient may retract the tongue in a curling motion by curling the tip of the tongue toward the back of the throat.

In some method steps, a patient may select a lever 245. With a lever 245, a patient may perform exercises to superiorly elevate the tongue 435. A patient may position a lever 245 in many angles in front of the mouth, may open the mouth, and may stick out the tongue to apply pressure to the lever 245. A lever 245 may be placed above or below the tongue to either elevate or depress or extend or flex the tongue. Furthermore, a patient may rotate the tongue in circular or semicircular motions for dynamic exercises.

CONCLUSION

A number of embodiments of the present disclosure have been described. While this specification contains many specific implementation details, no single implementation detail should be construed as limitations on the scope of any disclosures or of what may be claimed, but rather as descriptions of features specific to particular embodiments of the present disclosure. Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. An oropharyngeal isometric and dynamic exercise device having interchangeable parts, the device comprising:

a housing comprising a shaft opening at a proximal end of the housing, a door defining one side of the housing, a hinge on one edge of where the door and housing are attached, and a clasp on an opposite edge where the door and housing meet when the door is closed;

a progress gauge having progress marks about an edge of a longitudinal axis of the housing;

a stopper fixedly attached, to the housing on the edge opposite that of the progress gauge;

a complete spring comprising a spring, a base fixedly attached at a proximal end of the spring and a male fastener fixedly attached to a proximal end of the base, substantially in line along a longitudinal axis; and a complete mouthpiece comprising a mouthpiece, a mouthpiece stem attached distally to the mouthpiece, and a female fastener fixedly attached on a distal end of the mouthpiece stem, substantially in line along a longitudinal axis wherein the complete mouthpiece and complete spring are aligned along a longitudinal axis of the housing.

2. The device of claim 1 further comprising a shaft opening at the distal end of the housing and substantially in line with the complete spring along a longitudinal axis.

3. The device claim 2 further comprising a base with a male fastener fixedly attached to the distal end of the spring and substantially in line along a longitudinal axis.

4. The device of claim 1 wherein the spring has a pressure range from about 1 pounds per square inch to about 20 pounds per square inch.

5. The device of claim 1 wherein the male fastener and the female fastener are magnetic.

6. The device of claim 1 wherein the mouthpiece stem comprises a ball-and-socket joint at the distal end of the mouthpiece stem.

7. The device of claim 1 wherein the mouthpiece stem is telescopic.

8. The device of claim 1 wherein the mouthpiece is a tongue target.

9. The device of claim 1 wherein the mouthpiece is a tongue clamp.

10. The device of claim 1 wherein the mouthpiece is a lip piece.

11. The devive of claim 1 wherein the mouthpiece is a lever.

12. A kit for storing the oropharyngeal exercise device of claim 1, the kit comprising:

a kit container;

a plurality of storage compartments:

a plurality of molded complete mouthpiece holders;

a plurality of molded complete spring holders; and a molded housing holder.

13. The kit of claim 12 further comprising a compartment for storing documents, mouthpiece sheaths, disinfectant preparations, and writing utensils.

14. The kit of claim 12 wherein the storage compartments are removable.

15. A method of performing oropharyngeal isometric and dynamic exercises with the device of claim 1, the method steps comprising opening a kit by releasing a container clasp;

selecting the housing;

opening the housing by releasing the clasp which is on the housing;

selecting from a plurality of complete springs;

inserting the complete spring into the housing so that the base with male fastener faces the shaft opening, and the male fastener protrudes from the shaft opening;

closing the housing by securing the clasp which is in the housing;

selecting from a plurality of complete mouthpieces;

attaching the complete mouthpiece to the complete spring by inserting the protruding male fastener into the female fastener at distal end of the mouthpiece stem; and performing oropharyngeal exercises.

16. The method of claim 15 whereby a patient performs the oropharyngeal exercises with a tongue target by pressing the patient's tongue against the mouthpiece and moving the tongue anteriorly, laterally, superiorly, and outwardly.

17. The method of claim 15 whereby a patient performs the oropharyngeal exercises with a tongue target by placing the tongue target below the patient's chin and the patient opening the patient's mouth to depress the patient's jaw.

18. The method of claim 15 whereby a patient performs the oropharyngeal exercises with a lip piece by placing the lip piece between the patient's lips and approximating the lips.

19. The method of claim 15 whereby a patient performs the oropharyngeal exercises with a tongue clamp by positioning the patient's tongue within the clamp and posteriorly retracting a base of the patient's tongue.

20. The method of claim 15 whereby a patient performs the oropharyngeal exercises with a lever by pressing the patient's tongue to the lever and superiorly elevating and rotating the patient's tongue in circular motions.

* * * * *